US008899707B2

(12) United States Patent
Teraji

(10) Patent No.: US 8,899,707 B2
(45) Date of Patent: Dec. 2, 2014

(54) PRINTING APPARATUS

(71) Applicant: Canon Kabushiki Kaisha, Tokyo (JP)

(72) Inventor: Tomoya Teraji, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 41 days.

(21) Appl. No.: 13/712,355

(22) Filed: Dec. 12, 2012

(65) Prior Publication Data

US 2013/0194325 A1 Aug. 1, 2013

(30) Foreign Application Priority Data

Jan. 30, 2012 (JP) ..... 2012-017274

(51) Int. Cl.
*B41J 2/175* (2006.01)

(52) U.S. Cl.
CPC ..... *B41J 2/175* (2013.01); *B41J 2/17546* (2013.01); *B41J 2/17526* (2013.01); *B41J 2/1752* (2013.01)
USPC ..... 347/6; 347/19

(58) Field of Classification Search
CPC .... B41J 2/175; B41J 2/17546; B41J 2/17526; B41J 2/14072
USPC ..... 347/6, 19
See application file for complete search history.

(56) References Cited

U.S. PATENT DOCUMENTS

| | | | | |
|---|---|---|---|---|
| 6,217,144 | B1 | 4/2001 | Myung | |
| 2003/0142164 | A1 * | 7/2003 | Nishida | 347/19 |
| 2007/0211096 | A1 * | 9/2007 | Narushima et al. | 347/14 |

FOREIGN PATENT DOCUMENTS

JP 2930918 B2 8/1999

* cited by examiner

*Primary Examiner* — Geoffrey Mruk
*Assistant Examiner* — Scott A Richmond
(74) *Attorney, Agent, or Firm* — Fitzpatrick, Cella, Harper & Scinto

(57) ABSTRACT

Disclosed is a printing apparatus capable of safe high-speed leakage detection and contact detection of a printhead. The leakage detection and contact detection are executed in the apparatus which prints on a printing medium by scanning a removable printhead mounted to a carriage. When the printhead is mounted, connection with a capacitor used in normal printing is disconnected, a lower voltage is applied to drive a printing element and monitor the voltage. If the monitored voltage is not less than a predetermined threshold, occurrence of a poor contact is determined. This is performed for electric contacts one by one. During the operation, a lower voltage is applied at a predetermined timing to drive a printing element and monitor the voltage. If the monitor voltage is not higher than a predetermined threshold, occurrence of current leakage is determined.

14 Claims, 8 Drawing Sheets

PRINTING APPARATUS

BACKGROUND OF THE INVENTION

1. Field of the Invention

The present invention relates to a printing apparatus and, particularly to a printing apparatus in which a printhead is mounted on a carriage and the printhead prints while reciprocally scanning the carriage.

2. Description of the Related Art

In a printing apparatus configured to allow the user to replace a printhead mounted on a carriage, a poor contact between the electric contact of the printhead and the electric contact of the carriage that occurs when the user replaces the printhead has not completely been solved in practice though electric contacts have been improved.

The poor contact occurs when small dust is sandwiched between the electric contact of the printhead and that of the carriage upon replacing the printhead. Since this problem arises in the apparatus environment, it is difficult to solve this problem regardless of the improvement of the product. As a practical countermeasure to deal with the poor contact, a contact detection function may be arranged. When a poor contact is detected by contact detection, the user is notified of a message to this detection and prompted to mount the printhead again. The contact detection uses the same voltage as a voltage used in normal printing or a voltage close to it.

There is also a problem that, as the printhead is used for a long period, a circuit in the printhead goes wrong due to aging of the printhead, and a current leaks from the head voltage supply line, causing poor printing. To detect the leakage, a leakage detection function may be arranged. A poor printhead is detected by leakage detection, and the user is notified of a message to this detection and prompted to replace the printhead. Poor printing can therefore be prevented. Conventional leakage detection adopts an arrangement in which power used in normal printing and power used in leakage detection are supplied via the same line, as disclosed in, for example, Japanese Patent No. 2,930,918.

However, the conventional leakage detection uses the same power supply as that used in normal printing. Performing this detection requires time to accumulate charges in a large-capacity capacitor arranged to stabilize a voltage similarly to normal printing. For this reason, leakage detection takes time.

In the conventional arrangement in which the capacitor for stabilizing a head voltage is interposed between the printhead and GND, contact detection also requires a long time. To meet requests for higher resolutions and higher speeds of printing, many printing elements and many printing element arrays are arranged on the circuit substrate of a recent printhead. As a result, several tens to hundred electric contacts are arranged. In the conventional arrangement in which contact detection of one electric contact takes time, it is not even practical to implement contact detection in the apparatus. However, as the number of electric contacts which electrically connect the carriage and the printhead increases, the ratio of poor connections increases. Hence, it is highly desirable to implement contact detection.

Since contact detection of the printhead is a necessary function, to implement contact detection in a printing apparatus, increasing the process speed is an urgent matter. Also, leakage detection requires a high process speed.

In the conventional leakage detection arrangement, a normal head voltage or a voltage close to it is applied in leakage detection. If this arrangement is simply applied to contact detection, the printhead may be damaged in poor mounting of the printhead.

SUMMARY OF THE INVENTION

Accordingly, the present invention is conceived as a response to the above-described disadvantages of the conventional art.

For example, a printing apparatus according to one embodiment of this invention is capable of performing safe and high-speed leakage detection and contact detection of a printhead.

According to one embodiment of the present invention, there is disclosed a printing apparatus comprising: a printhead; a first power supply line which applies a first voltage to the printhead; a capacitor connected between the first power supply line and ground; a switch, interposed between the capacitor and the printhead on the first power supply line, configured to switch connection and disconnection between the capacitor and the printhead; a second power supply line, connected between the switch and the printhead, to apply a second voltage lower than the first voltage to the printhead; and a monitor unit configured to monitor a voltage applied to the printhead via the second power supply line while the switch disconnects the capacitor and the printhead.

One embodiment of this invention is particularly advantageous since a connection between a capacitor and a printhead made upon printing is disconnected, and the time taken to charge the capacitor becomes unnecessary. Accordingly, the speeds of contact check and current leakage detection can be increased.

Execution of contact check or current leakage detection uses a smaller power than that in execution of printing. A safer process can be performed without damaging printing elements by contact check and current leakage detection.

Further features of the present invention will become apparent from the following description of exemplary embodiments (with reference to the attached drawings).

DESCRIPTION OF THE EMBODIMENTS

An exemplary embodiment of the present invention will now be described in detail in accordance with the accompanying drawings. It should be noted that the relative arrangement of building components and the like set forth in the embodiment do not limit the scope of the present invention unless it is specifically stated otherwise.

In this specification, the terms "print" and "printing" not only include the formation of significant information such as characters and graphics, but also broadly includes the formation of images, figures, patterns, and the like on a print medium, or the process of the medium, regardless of whether they are significant or insignificant and whether they are so visualized as to be visually perceivable by humans.

Also, the term "print medium" not only includes a paper sheet used in common printing apparatuses, but also broadly includes materials, such as cloth, a plastic film, a metal plate, glass, ceramics, wood, and leather, capable of accepting ink.

Furthermore, the term "ink" (to be also referred to as a "liquid" hereinafter) should be extensively interpreted similar to the definition of "print" described above. That is, "ink" includes a liquid which, when applied onto a print medium, can form images, figures, patterns, and the like, can process the print medium, and can process ink. The process of ink includes, for example, solidifying or insolubilizing a coloring agent contained in ink applied to the print medium.

Further, a "printing element" (to be also referred to as a "nozzle") generically means an ink orifice or a liquid channel communicating with it, and an element for generating energy used to discharge ink, unless otherwise specified.

<General Outline of Printing Apparatus (FIGS. 1A and 1B)>

Figure 1A:
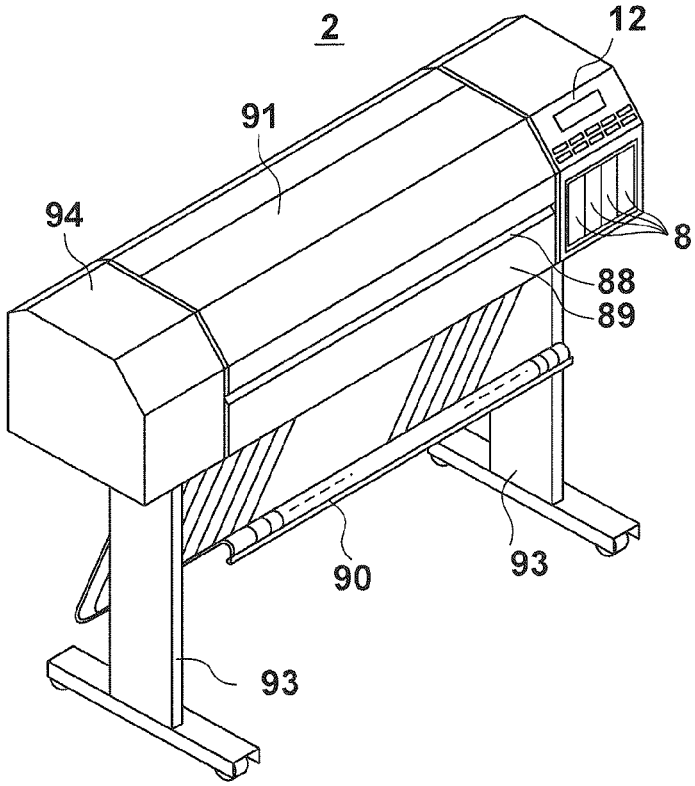
FIGS. 1A and 1B are perspective views showing the outer appearance of a printing apparatus using printing media of A0 and B0 sizes as a typical embodiment of the present invention.
Figure 1B:
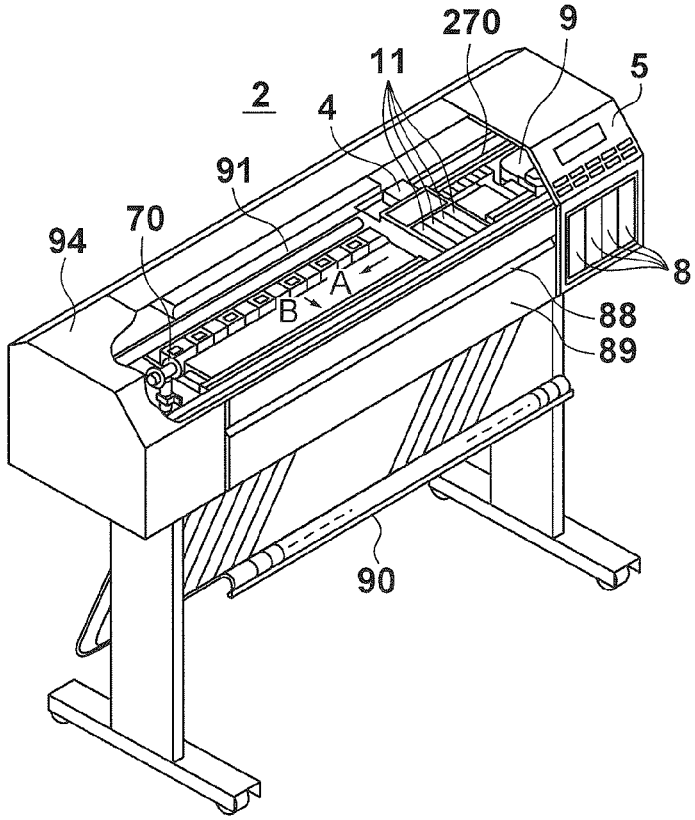

FIGS. 1A and 1B are perspective views showing the outer appearance of a printing apparatus using printing media of A0 and B0 sizes as a typical embodiment of the present invention. FIG. 1B is a perspective view showing a state in which the upper cover of the printing apparatus shown in FIG. 1A is removed.

As shown in FIG. 1A, a printing apparatus 2 has a manual insertion port 88 on the front surface, and a roll paper cassette 89 which can open to the front side is arranged below the manual insertion port 88. A printing medium such as printing paper is supplied from the manual insertion port 88 or roll paper cassette 89 into the printing apparatus. The printing apparatus 2 includes an apparatus main body 94 supported by two legs 93, a stacker 90 in which a discharged printing medium is stacked, and an openable/closable see-through upper cover 91. An operation unit 12, an ink supply unit, and ink tanks are arranged on the right side of the apparatus main body 94.

As shown in FIG. 1B, the printing apparatus 2 includes a conveyance roller 70 for conveying a printing medium in a direction (sub-scanning direction) indicated by an arrow B, and a carriage 4 which is guided and supported to be able to reciprocate in directions (indicated by an arrow A: main scanning direction) of width of the printing medium. The printing apparatus 2 further includes a carriage motor (not shown) for reciprocating the carriage 4 in the directions indicated by the arrow A, a carriage belt (to be referred to as a belt hereinafter) 270, and a printhead 11 mounted on the carriage 4. Also, the printing apparatus 2 includes a suction ink recovery unit 9 which supplies ink and eliminates poor ink discharge caused by clogging of the orifice of the printhead 11 or the like. The printhead 11 is removable from the carriage 4. The printhead 11 can be mounted again in poor mounting on the carriage or replaced with a new printhead.

In this printing apparatus, to print in color on a printing medium, the carriage 4 supports the inkjet printhead (to be referred to as a printhead hereinafter) 11 formed from four heads in correspondence with four color inks. More specifically, the printhead 11 is formed from, for example, a K (blacK) head for discharging K ink, a C (Cyan) head for discharging C ink, an M (Magenta) head for discharging M ink, and a Y (Yellow) head for discharging Y ink.

When printing on a printing medium by the above arrangement, the conveyance roller 70 conveys a printing medium to a predetermined printing start position. Then, the carriage 4 scans the printhead 11 in the main scanning direction, and the conveyance roller 70 conveys the printing medium in the sub-scanning direction. By repeating these operations, the printing apparatus prints on the entire printing medium.

More specifically, the belt 270 and carriage motor (not shown) move the carriage 4 in the directions indicated by the arrow A shown in FIG. 1B, thereby printing on a printing medium. The carriage 4 then returns to a position (home position) before scanning, and the conveyance roller conveys the printing medium in the sub-scanning direction (direction indicated by the arrow B shown in FIG. 1B). After that, the carriage scans again in the directions indicated by the arrow A in FIG. 1B. In this manner, an image, character, or the like is printed on the printing medium. This operation is repeated, and after the end of printing on one printing medium, the printing medium is discharged into the stacker 90, completing printing on one printing medium.

<Description of Control Arrangement (FIG. 2)>

Figure 2:
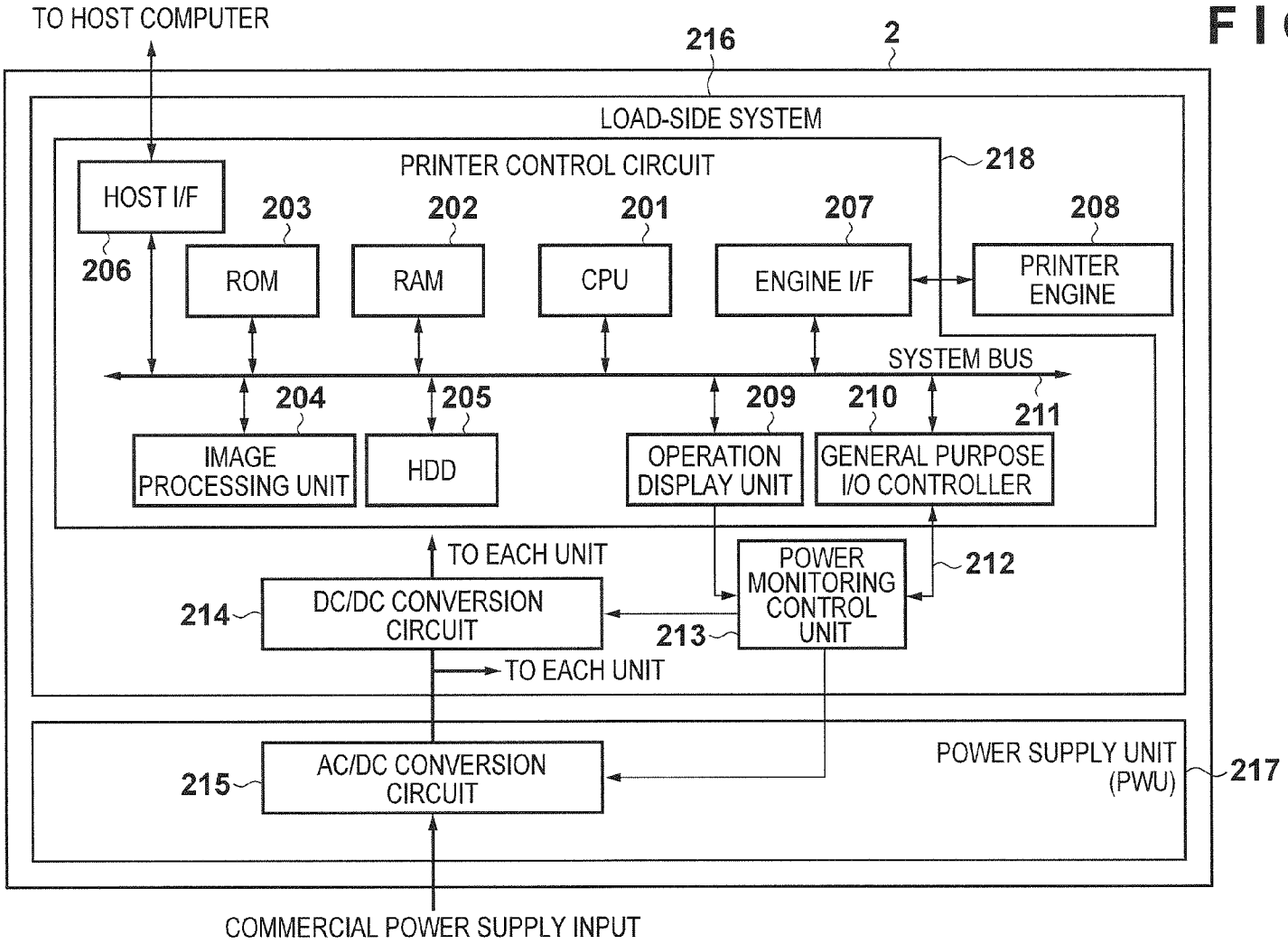
FIG. 2 is a block diagram showing the control arrangement of the printing apparatus shown in FIGS. 1A and 1B.

FIG. 2 is a block diagram showing the arrangement of the control circuit of the printing apparatus.

As shown in FIG. 2, the printing apparatus 2 includes a load-side system 216 and power supply unit (PWU) 217. The load-side system 216 includes a printer engine 208, printer control circuit 218, power monitoring control unit 213, and DC/DC conversion circuit 214. The printer control circuit 218 includes a CPU 201, RAM 202, ROM 203, image processing unit 204, HDD 205, host interface 206, engine interface 207, operation display unit 209, general purpose I/O controller 210, and system bus 211. The printer engine 208 includes a mechanism as shown in FIGS. 1A and 1B. The printer control circuit 218 controls the operation of the printer engine 208 via the engine interface (I/F) 207.

Blocks except for the printer engine 208, power monitoring control unit 213, and DC/DC conversion circuit 214 are connected to each other by the system bus 211. The power supply unit 217 is formed from an AC/DC conversion circuit 215 which converts a commercial AC power supply input into DC power and outputs the DC power. The load-side system 216 and power supply unit 217 are electrically connected using a connector, cable, or the like (not shown).

The CPU 201 controls the overall printing apparatus 2. The CPU 201 controls the operation of the overall printing apparatus 2 by executing an operation control program stored in the RAM 202 or ROM 203. More specifically, the CPU 201 executes control of the image processing unit 204 to convert print job data received from a host computer (to be referred to as a host hereinafter) into image data to be output onto a printing medium, control of the operation display unit 209, and control of the general purpose I/O controller 210. The CPU 201 also executes control of the engine interface 207 to transfer image data generated by the image processing unit 204 to the printer engine 208.

The RAM 202 includes a RAM device, and a RAM controller which controls access to the RAM device. The RAM device serves as a work memory used when executing an operation control program by the CPU 201, and as a buffer memory for storing various intermediate data generated during execution of a print process. In addition, the RAM device serves as another buffer memory for temporarily storing various data (print job data and various control data) transmitted/received between the printing apparatus 2 and the host.

The ROM 203 includes a ROM device, and a ROM controller which controls access to the ROM device. The ROM device is a non-volatile memory which stores operation control programs to be executed by the CPU 201, various data for printing control, various screen data to be displayed on the LCD of the operation display unit 209, and the like. The ROM 203 outputs stored information to the system bus 211 in accordance with an instruction from the CPU 201. The operation control programs include various programs such as a program for controlling the printer engine 208.

The image processing unit 204 performs a color space conversion process, gamma correction process, quantization process based on the error diffusion method, and the like for image data transmitted as print job data from the host, and generates binary image data which can be output from the printer engine.

The HDD 205 includes a Serial ATA hard disk drive, and a bridge that connects the system bus 211 and the Serial ATA interface of the hard disk drive. The HDD 205 operates as an external mass storage device for the printing apparatus 2, and stores and saves print job data received from the host via the host interface (I/F) 206.

The host interface 206 connects the printing apparatus 2 and host (not shown), and transmits/receives data between them. Print job data received from the host computer via the host interface 206 is stored in the RAM 202 via the system bus 211. The host interface 206 adopts a serial communication method such as USB, and a network communication method such as 1000 Base-TX.

The engine interface 207 connects the printer engine 208 and system bus 211. The engine interface 207 sequentially reads out binary image data which have been generated by the image processing unit 204 and stored in the RAM 202, and transfers them to the printer engine 208.

The printer engine 208 includes a printhead, a carriage on which the printhead is mounted, a driving mechanism and control circuit for the carriage, a printing medium feeding facility, a control circuit for it, a mechanism which controls supply of ink from the ink tank to the printhead, and a control circuit for it. The arrangement of the printer engine 208 has already been described with reference to FIGS. 1A and 1B.

The operation display unit 209 is substantially formed from an LCD, an LED, a control circuit for it, and various buttons arranged on the operation panel 12. Each button has a switch interlocked with the button. The state of the switch is output as an electrical signal to notify the CPU of the state via the control circuit. The control circuit of the operation display unit has a function of outputting electrical signals to, for example, the LCD for menu display and the LED for state display which are arranged on the operation display unit 209.

In addition, the operation display unit 209 includes a power button for the power on/off operation of the printing apparatus 2, a cancel button for canceling printing, a menu button for displaying various operation/setting menus, and a four-way selector cursor button for selecting items on the menu screen. Note that switches which form all buttons including the power button are of a momentary type, that is, are switches which operate only during pressing of corresponding buttons.

The printing apparatus 2 has a power on/off function by soft control, and operates as follows in accordance with the operation of the power button. Assume that the printing apparatus 2 is connected to a commercial power supply and power can be supplied.

First, when the power button is pressed while the printing apparatus 2 is in a shut down state (power supply to the printer control circuit 218 is OFF), a latch circuit (not shown) in the power monitoring control unit 213 latches the button pressing state. Then, a high-level signal is output from the latch circuit, input to the DC/DC conversion circuit 214, and acts as an operation permission signal for the DC/DC conversion circuit 214. As a result, the DC/DC conversion circuit 214 starts operating, and power is supplied to the printer control circuit 218, activating the apparatus.

When the power button is pressed for a predetermined time or longer while the printing apparatus 2 is in an active state, the CPU 201 executes a predetermined apparatus shutdown pre-process, and outputs, via the general purpose I/O controller 210, a signal for canceling the latch state of the latch circuit in the power monitoring control unit 213. In response to this, the output from the latch circuit changes to low level. The DC/DC conversion circuit 214 is turned off to stop the voltage conversion operation, shutting down the apparatus (shifting to the stopped state).

The general purpose I/O controller 210 has a function of controlling an I/O port 212. The I/O port 212 functions as an input port or output port in accordance with a parameter set in a register arranged in the general purpose I/O controller 210. The power monitoring control unit 213 and another circuit block (not shown) are controlled via the I/O port 212 which is set as the output. A signal output from the power monitoring control unit 213 is received via the I/O port 212, which is set as the input, to acquire a power supply output state. In addition, the I/O port 212 implements a function of detecting a pressing operation to the power button in the system activation state.

The power monitoring control unit 213 includes the latch circuit which latches a power button pressing state, and a transistor which converts the logic of a signal output from the latch circuit. An output signal from the latch circuit is used as a control signal for the power supply unit 217 and DC/DC conversion circuit 214.

The DC/DC conversion circuit 214 has a function of converting a DC output voltage output from the AC/DC conversion circuit 215 into a predetermined DC voltage necessary for each block of the load-side system 216, and outputting and distributing the DC voltage. The DC/DC conversion circuit 214 includes a switching regulator and its peripheral circuit.

In addition to a voltage V1 to be applied to a printing element in a normal print operation, a second voltage V2 lower than the first voltage V1 is output to the printhead 11 for leakage detection and contact check to be described in the embodiment.

The AC/DC conversion circuit 215 has a function of converting a commercial AC voltage input into a DC voltage, and outputting the DC voltage. The AC/DC conversion circuit 215 includes a step-down electrical transformer, a rectifying circuit which converts AC power into DC power, and an output stabilization circuit. Note that the voltage V2 used in leakage detection and contact check may be output from the AC/DC conversion circuit 215 to the printhead 11 via a regulator (not shown).

<Nozzle Arrangement of Printhead (FIG. 3)>

Figure 3:
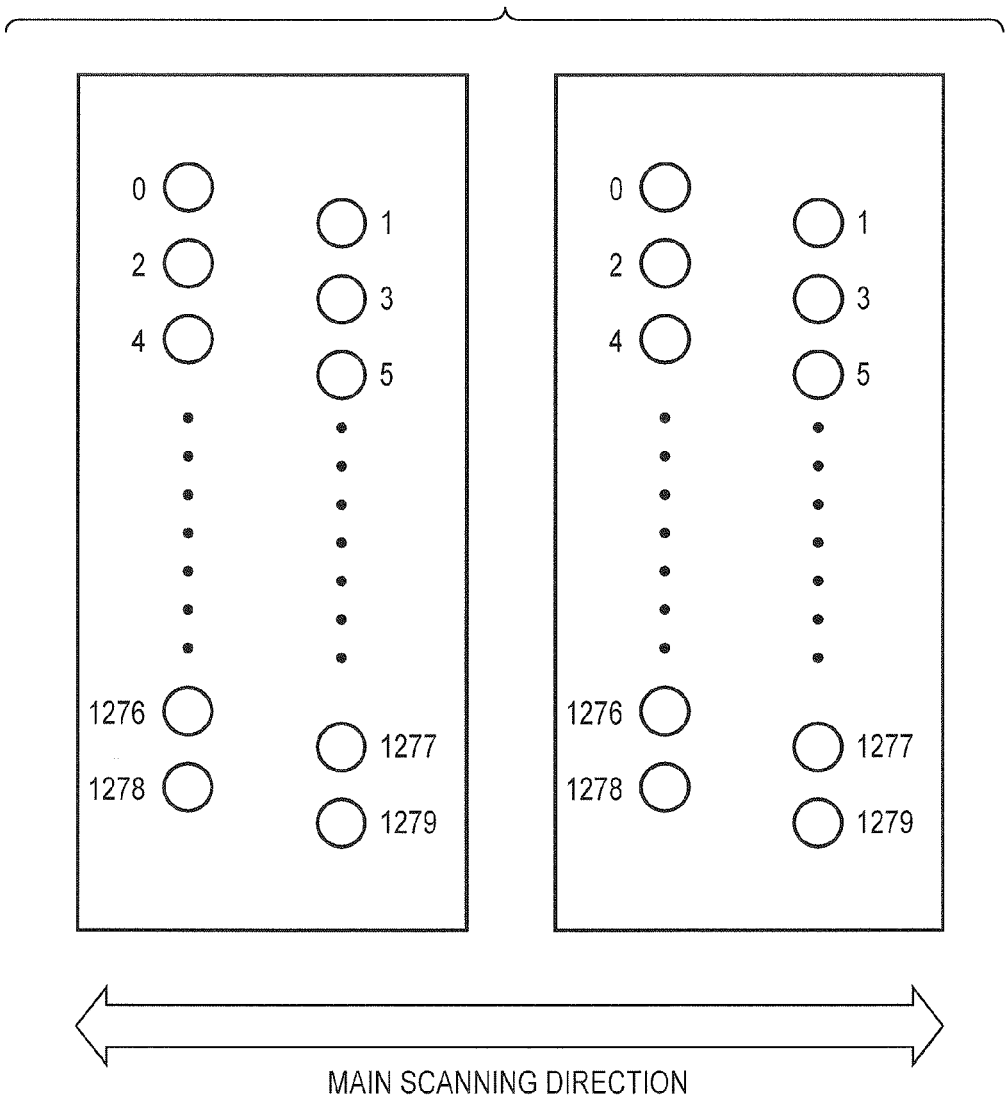
FIG. 3 is a view showing the arrangement of layout of printing element arrays of, for example, a K head which is arranged in a printhead and discharges ink of one color.

FIG. 3 is a view showing the arrangement of layout of printing element arrays of, for example, the K head which is arranged in the printhead 11 and discharges ink of one color. FIG. 3 shows the ink discharge surface of the head. In FIG. 3, four nozzle arrays are arranged from the left. Two nozzle arrays (printing elements) on the right side and two nozzle arrays on the left side are aligned with the same structure. In two nozzle arrays on each of the right and left sides, 1,280 nozzles are arranged in a staggered pattern. Two, even-numbered nozzle array of 640 even-numbered nozzles (nozzle numbers 0, 2, . . . , 1278), and odd-numbered nozzle array of 640 odd-numbered nozzles (nozzle numbers 1, 3, . . . , 1279) are formed.

As shown in FIG. 3, the even-numbered nozzle array and odd-numbered nozzle array are arranged with a shift of a half pitch of the nozzle interval. This arrangement doubles the resolution in the sub-scanning direction. By discharging the same ink from the two nozzle arrays on the right side and the two nozzle arrays on the left side, the ink can be discharged at double the discharge frequency in the main scanning direction, achieving high-speed printing.

The main scanning direction shown in FIG. 3 is the moving direction of the carriage 4. The sub-scanning direction is a direction perpendicular to the main scanning direction, in which a printing medium is conveyed and nozzles are arrayed. Note that the nozzle array direction need not always be the same direction as the sub-scanning direction, and suffices to be a direction intersecting the main scanning direction.

In the actual printhead 11, four sets each of the nozzle arrays shown in FIG. 3 are arranged in the main scanning direction in correspondence with Y, M, C, and K inks.

The arrangement having one set of the nozzle arrays shown in FIG. 3 can be properly added in accordance with the number of inks used in the printhead. For example, as for K ink, when dye black ink, pigment black ink, and gray ink whose dye concentration is suppressed are used, the printhead can employ six sets each of the nozzle arrays shown in FIG. 3.

When printing by reciprocal scanning of the carriage, two printheads having nozzle arrays symmetrical in forward printing and backward printing can be mounted.

<Arrangement for Leakage Detection and Contact Check (FIG. 4)>

Figure 4:
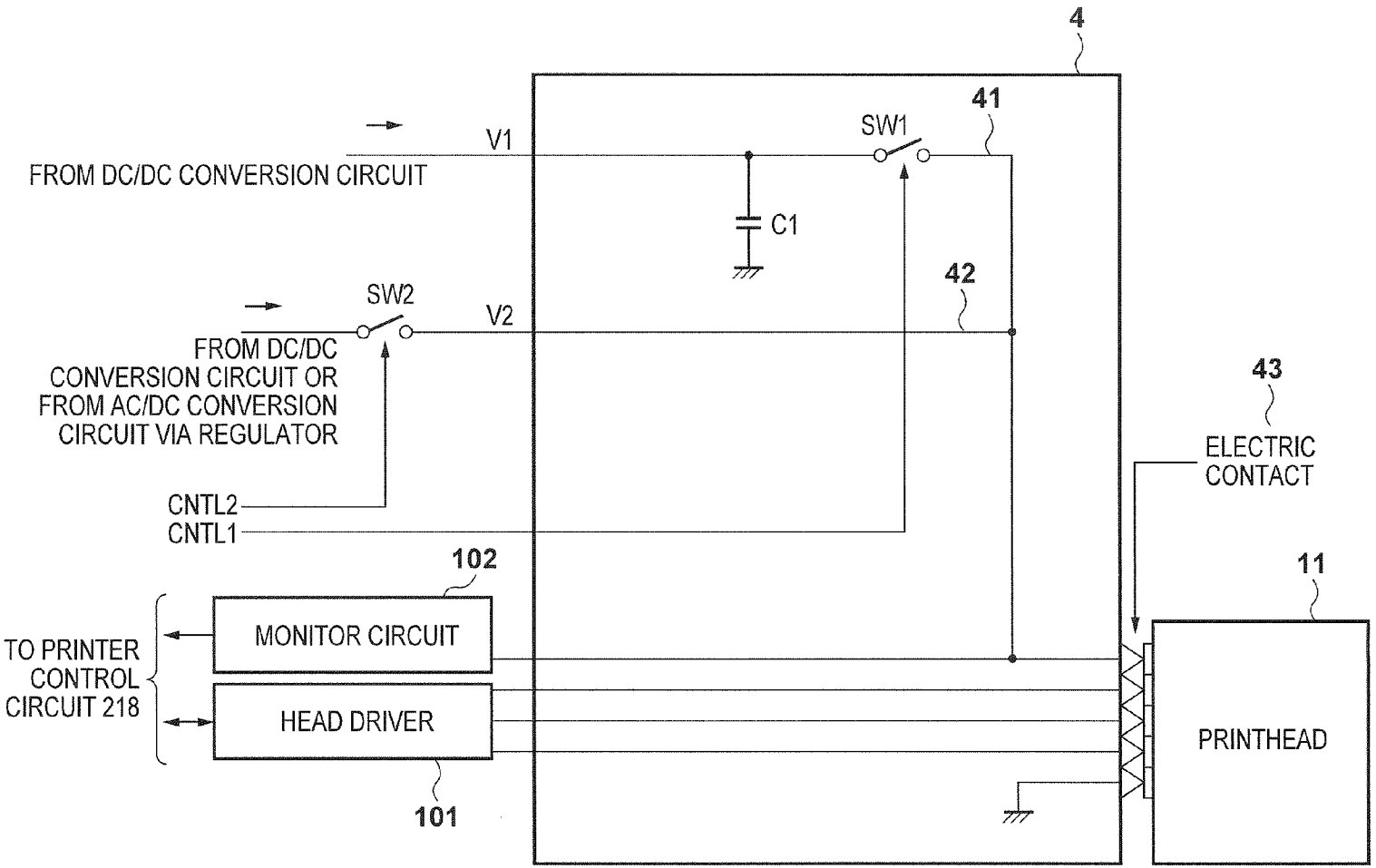
FIG. 4 is a block diagram for explaining an arrangement which executes leakage detection and contact check of the printhead by the printing apparatus.

FIG. 4 is a block diagram for explaining an arrangement which executes leakage detection and contact check of the printhead by the printing apparatus according to the embodiment.

When the printhead 11 is mounted on the carriage 4, it is electrically connected to the printer engine 208 and printer control circuit 218 of the printing apparatus via a plurality of electric contacts 43 and the carriage 4. The printhead 11 receives power necessary for its operation via a flexible printer cable (FPC: not shown) and the carriage 4. As shown in FIG. 4, the first voltage V1 to be applied to printing elements in a normal print operation is supplied from the DC/DC conversion circuit 214 to the printhead 11 via the carriage 4. To stabilize the head voltage, an electrolyte capacitor C1 having a large capacitance is connected between a power line for supplying the first voltage V1, and ground GND in parallel with the power line.

In the carriage 4, a first switch SW1 formed from a semiconductor transistor or the like is arranged on a first power line 41 which supplies the first voltage V1. The first switch SW1 can switch application ON and OFF of the first voltage V1 to the printhead 11. The first switch SW1 is ON/OFF-controlled by a first control signal CNTL1 supplied from the printer control circuit 218.

On the other hand, the second voltage V2 lower than the first voltage V1 is supplied to the printhead 11 via the carriage 4 for leakage detection and contact check. As described above, the second voltage V2 may be supplied from the DC/DC conversion circuit 214 or from the AC/DC conversion circuit 215 via the regulator.

Note that V1=24 V and V2=20 V in the embodiment, but V1 and V2 may be voltages of other values, as a matter of course.

A second switch SW2 formed from a semiconductor transistor or the like is also arranged on a second power line 42 which supplies the second voltage V2. The second switch SW2 can switch application ON and OFF of the second voltage V2 to the printhead 11. The second switch SW2 is arranged outside the carriage 4, for example, in the printer engine 208 or the printer control circuit 218. This can simplify the electrical arrangement in the carriage 4. The second switch SW2 is also ON/OFF-controlled by a second control signal CNTL2 supplied from the printer control circuit 218.

A monitor circuit 102 monitors a voltage applied to the printhead 11 via the electric contacts 43 along the first and second power lines 41 and 42. The result of monitoring by the monitor circuit 102 is output to the printer control circuit 218. In addition, driving signals for driving the printhead, such as a print data signal, clock signal, and heat enable signal from the printer control circuit 218 via a head driver 101 are supplied to the printhead 11 via the carriage 4. For descriptive convenience, three signal lines extending from the head driver 101 are connected to the electric contacts 43. However, signal lines are arranged in the driving unit of printing elements. The driving unit is, for example, the printing element unit, or the block unit or printing element array unit for driving by time division. Note that the head driver 101 and monitor circuit 102 are arranged outside the carriage 4, for example, in the printer engine 208 or the printer control circuit 218.

By this arrangement, leakage detection and contact check of the printhead are executed. However, the above-described embodiment is merely illustrative. It suffices that power supplied to the printhead for leakage detection and contact check is smaller than power supplied to the printhead for a normal print operation. In other words, power applied via the second power line 42 is smaller than power applied via the first power line 41. Hence, an embodiment in which the first voltage V1 and second voltage V2 are equal to each other and a current through the second power line 42 is smaller than that through the first power line 41 is possible.

The arrangement shown in FIG. 4 executes leakage detection and contact check for one printhead. However, leakage detection and contact check can be similarly executed even in a printing apparatus in which two printheads are mounted, as described above.

Figure 5A:
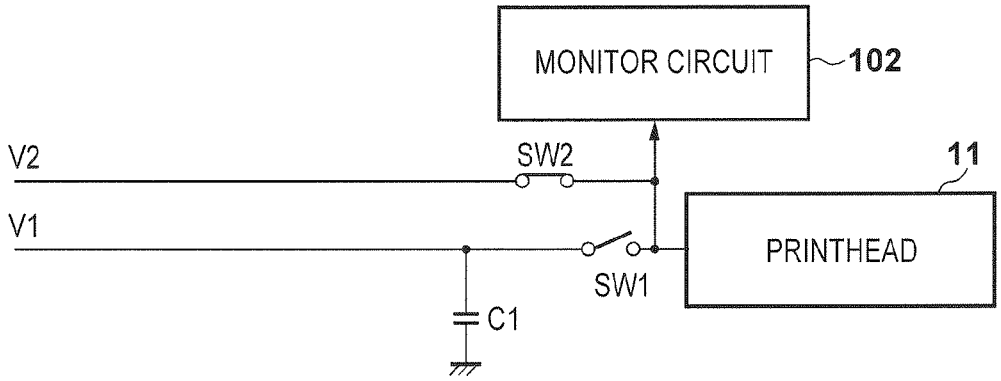
FIGS. 5A and 5B are block diagrams showing a conceptual arrangement when leakage detection and contact check are executed for one printhead, and a conceptual arrangement when leakage detection and contact check are executed for two printheads.
Figure 5B:
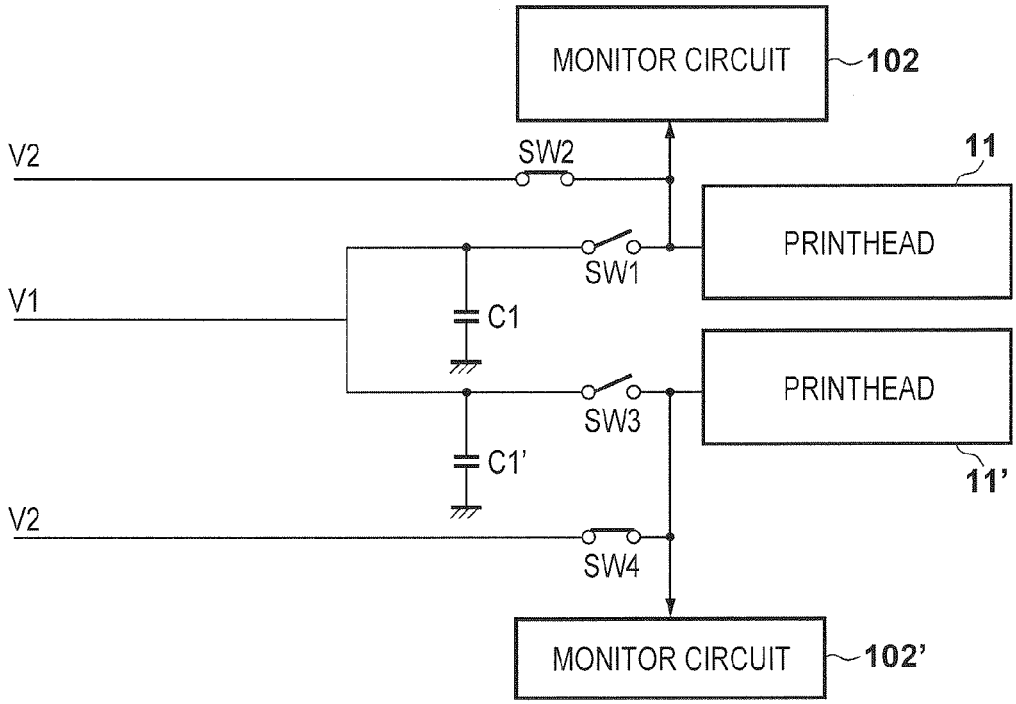

FIGS. 5A and 5B are block diagrams showing a conceptual arrangement when leakage detection and contact check are executed for one printhead, and a conceptual arrangement when leakage detection and contact check are executed for two printheads.

FIG. 5A shows a conceptual arrangement when leakage detection and contact check are executed for one printhead. This arrangement is more conceptual than the arrangement shown in FIG. 4. To the contrary, FIG. 5B shows a conceptual arrangement when leakage detection and contact check are executed for two printheads 11 and 11'. In this case, arrangements which apply the second voltage V2 to the respective printheads, and separate switches SW3 and SW4 which are separately switchable between the first voltage V1 and the second voltage V2 to each printhead are added. Further, monitor circuits 102 and 102' are arranged to monitor voltages to the respective printheads.

Details of a leakage detection process and contact check process using the above-described printing apparatus will be explained.

<Contact Check Process (FIGS. 6 and 7)>

Figure 6:
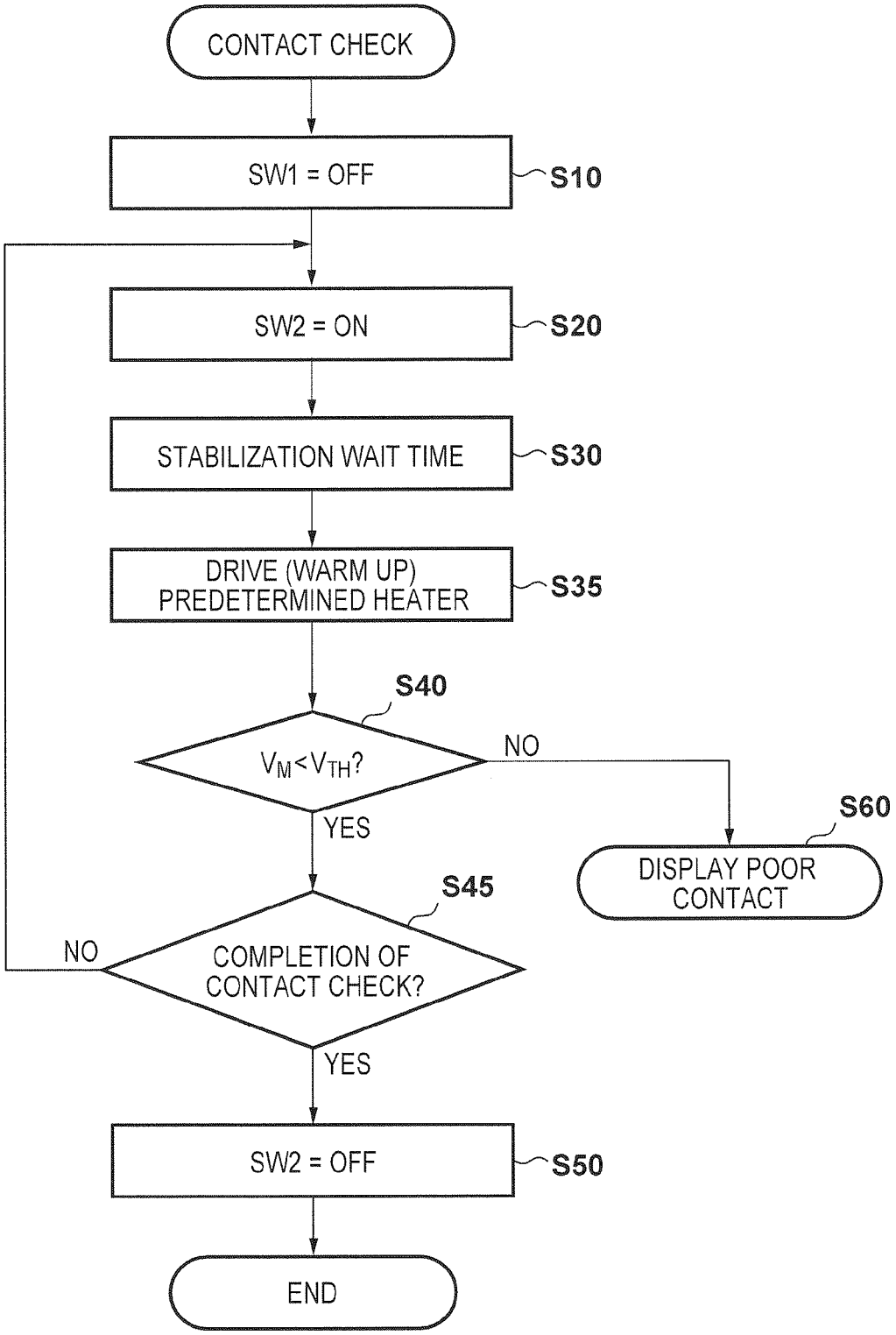
FIG. 6 is a flowchart showing a contact check process which is automatically executed when the printhead is mounted on a carriage.

FIG. 6 is a flowchart showing a contact check process which is automatically executed when the printhead is mounted on the carriage. The CPU 201 executes this process in accordance with a control program stored in the ROM 203.

When the printing apparatus is turned on and the printhead 11 is mounted in the printing apparatus, the CPU 201 turns off the first switch SW1 using the first control signal CNTL1 in step S10. In step S20, the CPU 201 turns on the second switch SW2 using the second control signal CNTL2. In response to this, the second voltage V2 (=20 V) is applied to the printhead 11 via the power line 42.

In step S30, the process waits for a predetermined time until the voltage stabilizes. The wait time is a value of the order of about 1 msec.

In step S35, the head driver 101 outputs a control signal and driving signal to the printhead 11. An energy small enough not to discharge ink is applied to the printing element (heater) in a predetermined order so as to drive it and warm it up.

Figure 7:
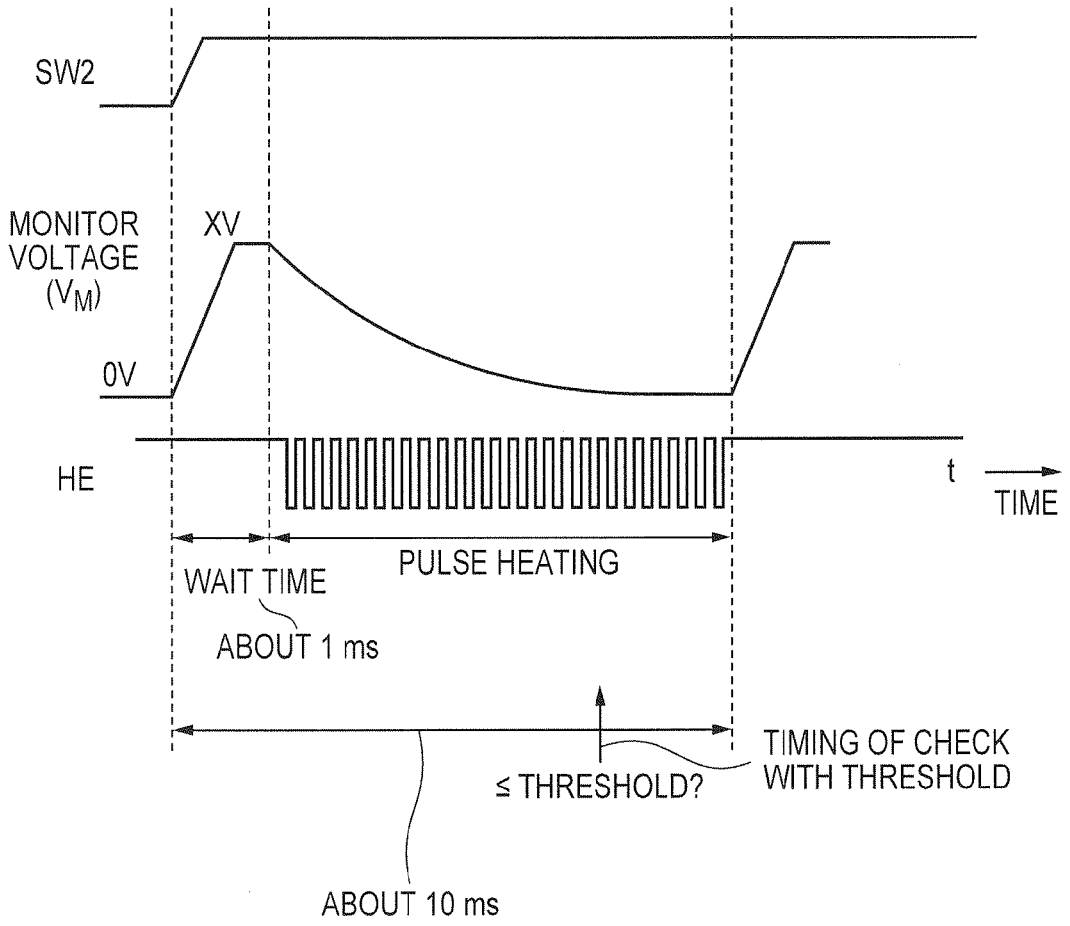
FIG. 7 is a timing chart showing a temporal change of a voltage obtained by monitoring a voltage (monitor voltage $V_M$) appearing on a power line by a monitor circuit.

FIG. 7 is a timing chart showing a temporal change of a voltage obtained by monitoring a voltage (monitor voltage $V_M$) appearing on the power line 42 by the monitor circuit 102.

FIG. 7 shows the profile of a monitor voltage obtained when the second switch SW2 is turned on, the printing apparatus waits until the monitor voltage $V_M$ stabilizes, and a heat enable signal HE for PWM-driving the printing element is input. This profile does not change like a pulse because the parasitic capacitance of the circuit is integrated over time. The pattern of the heat enable signal HE used here is stored as a test pattern in the ROM 203 for the contact check process.

This profile can be obtained by applying the second voltage V2 (=20 V) and outputting a driving signal (first driving signal) to the printhead via a specific electric contact (first electric contact) out of a plurality of electric contacts. Note that a similar profile can be obtained by outputting another driving signal (second driving signal) to the printhead via another electric contact (second electric contact) and driving another printing element. By outputting the driving signal to the printhead sequentially via different electric contacts, all the electric contacts of the printhead can be checked.

As shown in FIG. 7, the time necessary to obtain the profile of the monitor voltage by output of one driving signal is about 10 msec. Since the printhead has a plurality of (several tens to hundred) electric contacts, as described above, the time necessary to check all electric contacts is about 1 sec.

Referring back to FIG. 6, in step S40, the monitor voltage $V_M$ is compared with a predetermined threshold $V_{TH}$. If $V_M<V_{TH}$ (lower than the threshold), the process advances to step S45. If $V_M \geq V_{TH}$ (equal to or higher than the threshold), it is determined that the electric contact during check is a poor contact, and the process advances to step S60. In step S60, a message that the poor contact has occurred is displayed on the LCD of the operation display unit 209 to prompt the user to mount the printhead again. At this time, a warning process may be performed to turn on a specific lamp (not shown) arranged in the operation display unit. If all the electric contacts of the printhead are properly connected to corresponding electric contacts of the carriage, the process in step S60 is not executed.

In step S45, it is confirmed whether or not all the electric contacts have been checked. If it is determined that an unchecked electric contact still remains, the process returns to step S20 to check the unchecked electric contact. If it is determined that all the electric contacts have been checked, the process advances to step S50.

Finally in step S50, the second switch SW2 is turned off, using the second control signal CNTL2, and the contact check process ends.

<Leakage Detection Process (FIG. 8)>

Figure 8:
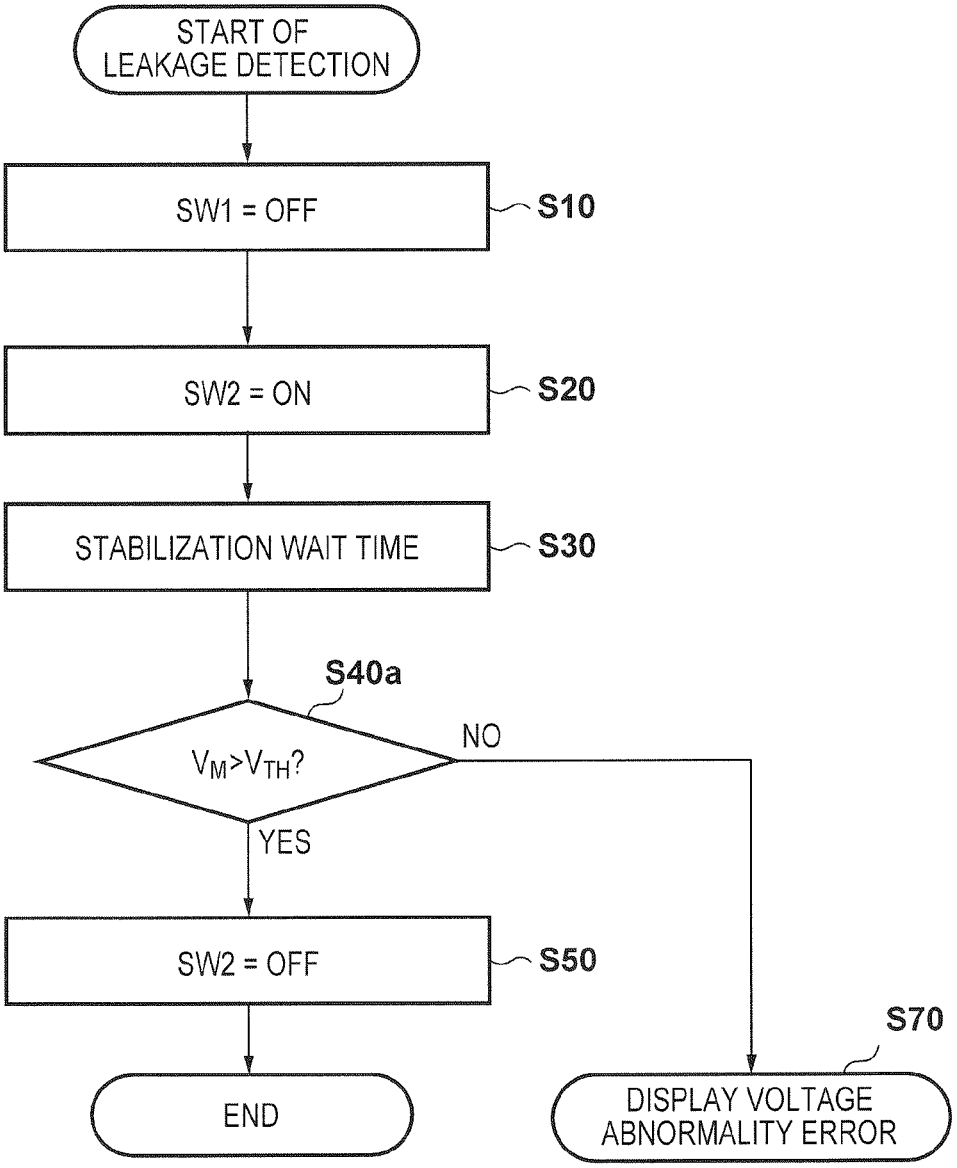
FIG. 8 is a flowchart showing a leakage detection process which is executed intermittently during the operation of the printing apparatus.

FIG. 8 is a flowchart showing a leakage detection process.

This process may be executed during the operation of the printing apparatus intermittently at a predetermined timing such as every predetermined time, every time printing of one page of a printing medium ends, or every time continuous printing of a predetermined number of printing media ends. Further, this process may be executed before the start of printing one page of a printing medium. When the printing apparatus shifts from the power saving state to the normal power consumption state, this process may be executed. As is apparent from a comparison between FIGS. 6 and 8, the individual processes of respective steps are common. Thus, the same step reference numerals denote the same process steps, and a description thereof will not be repeated. Only processes unique to the leakage detection process will be explained.

In the leakage detection process, after steps S10 to S30, the monitor voltage $V_M$ detected by the monitor circuit 102 is compared with the predetermined threshold $V_{TH}$. Although the same threshold as that used in contact check is used to simplify the process, another value may be used as the threshold. If $V_M>V_{TH}$ in step S40*a*, the process advances to step S50 to perform the same process as that in the contact check process. If $V_M \leq V_{TH}$ (equal to or lower than the threshold) in step S40*a*, the process advances to step S70.

In step S70, a message that current leakage has occurred is displayed on the LCD of the operation display unit 209 to prompt the user to mount the printhead again or replace the printhead. At this time, a warning process may be performed to turn on a specific lamp (not shown) arranged in the operation display unit.

According to the above-described embodiment, when contact check or current leakage detection is executed; the large-capacity capacitor C1 is always disconnected from the circuit. Thus, the time taken to accumulate charges in the capacitor becomes unnecessary. This increases the process speed. Also, when contact check or current leakage detection is executed, a voltage lower than a normal one is used. A safe process is therefore implemented without damaging printing elements by these processes.

The error process described in step S60 or S70 may be executed not only in the printing apparatus but also in the host connected to the printing apparatus.

Note that the above-described embodiment uses a so-called large-format printing apparatus which prints on printing media of A0 and B0 sizes. However, the present invention is applicable to a printing apparatus which prints on printing media of relatively small sizes such as A4, A3, B4, and B5.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-017274, filed Jan. 30, 2012, which is hereby incorporated by reference herein in its entirety.

What is claimed is:

1. A printing apparatus comprising:

a printhead;

a first power supply line which applies a first voltage to the printhead;

a capacitor which is connected between the first power supply line and ground;

a first switch, interposed between the capacitor and the printhead on the first power supply line, configured to switch connection and disconnection between the capacitor and the printhead;

a second power supply line which is connected between the first switch and the printhead to apply a second voltage lower than the first voltage to the printhead;

a monitor unit configured to monitor a voltage applied to the printhead via the second power supply line while the first switch disconnects the capacitor and the printhead; and a control unit configured to compare the voltage monitored by the monitor unit with a predetermined threshold, and in a case where the monitored voltage is not lower than the predetermined threshold, determine that a poor contact has occurred.

2. The apparatus according to claim 1, wherein in a case where the apparatus is printing on a printing medium using the printhead, the first switch connects the capacitor and the printhead.

3. The apparatus according to claim 1, further comprising:

a second switch, provided on the second power supply line, configured to cut off application of the second voltage to the printhead.

4. The apparatus according to claim 1, further comprising:

a carriage which includes the printhead, the capacitor, and the first switch.

5. The apparatus according to claim 1, wherein the control unit is further configured to control the first switch.

6. The apparatus according to claim 1, wherein the printhead and a carriage, respectively, include a plurality of electric contacts for electrical connection between the printhead and the carriage, and the control unit outputs, via the plurality of electric contacts one by one, a driving signal for driving a specific printing element among a plurality of printing elements included in the printhead, and performs contact check for each of the plurality of electric contacts.

7. The apparatus according to claim 1, wherein the printhead includes an inkjet printhead which prints by discharging ink onto a printing medium.

8. The apparatus according to claim 1, further comprising:

a notification unit configured to generate notification information indicating that the poor contact has occurred.

9. A printing apparatus comprising:

a printhead;

a first power supply line which applies a first voltage to the printhead;

a capacitor which is connected between the first power supply line and ground;

a first switch, interposed between the capacitor and the printhead on the first power supply line, configured to switch connection and disconnection between the capacitor and the printhead;

a second power supply line which is connected between the first switch and the printhead to apply a second voltage lower than the first voltage to the printhead;

a monitor unit configured to monitor a voltage applied to the printhead via the second power supply line while the first switch disconnects the capacitor and the printhead; and a control unit configured to compare the voltage monitored by the monitor unit with a predetermined threshold, and in a case where the monitored voltage is not higher than the predetermined threshold, determine that current leakage has occurred.

10. The apparatus according to claim 9, wherein in a case where the apparatus is printing on a printing medium using the printhead, the first switch connects the capacitor and the printhead.

11. The apparatus according to claim 9, further comprising:

a second switch, provided on the second power supply line, configured to cut off application of the second voltage to the printhead.

12. The apparatus according to claim 9, further comprising:

a carriage which includes the printhead, the capacitor, and the first switch.

13. The apparatus according to claim 9, wherein the control unit is further configured to control the first switch.

14. The apparatus according to claim 9, further comprising:

a notification unit configured to generate notification information indicating that the current leakage has occurred.

* * * * *